US005678267A

United States Patent [19]

Kinder

[11] Patent Number: 5,678,267

[45] Date of Patent: Oct. 21, 1997

[54] MEDICAL EXAMINATION TABLE HANDLE SYSTEM

[76] Inventor: Florence E. Kinder, 13771 Bowen St., Garden Grove, Calif. 92643

[21] Appl. No.: 500,520

[22] Filed: Jul. 11, 1995

[51] Int. Cl.[6] ..... A61G 7/06

[52] U.S. Cl. ..... 5/662; 5/428; 5/430; 5/658; 601/24

[58] Field of Search ..... 5/662, 424, 425, 5/428, 430, 427, 503.1, 658; 16/112, 111 R; 220/756, 759, 762, 752; 482/57, 142, 130; 601/24

[56] References Cited

U.S. PATENT DOCUMENTS

| | | | |
|---|---|---|---|
| D. 308,779 | 6/1990 | Foster | D6/491 |
| 2,585,660 | 2/1952 | Kjos et al. | 5/317 |
| 2,703,265 | 5/1955 | Wolfe | 5/503.1 |
| 2,807,032 | 9/1957 | Tunney | 5/503.1 |
| 2,904,798 | 9/1959 | Heflin | 5/507.1 |
| 3,310,817 | 3/1967 | Harding | 5/92 |
| 3,339,913 | 9/1967 | Anderson | 5/621 |
| 4,747,171 | 5/1988 | Einsele et al. | 5/430 |
| 4,771,492 | 9/1988 | Paine et al. | 5/428 |
| 5,060,327 | 10/1991 | Celestina et al. | 5/445 |
| 5,129,117 | 7/1992 | Celestina et al. | 5/602 |
| 5,231,721 | 8/1993 | Fish | 5/662 |
| 5,263,915 | 11/1993 | Habing | 482/908 |
| 5,384,927 | 1/1995 | Mardero et al. | 5/662 |

*Primary Examiner*—Steven N. Meyers
*Assistant Examiner*—Fredrick Conley
*Attorney, Agent, or Firm*—Stetina Brunda Garred & Brucker

[57] ABSTRACT

A handle system for a medical examination table includes a rail mounted to the side of the table, a guide member slidably connected to the rail, a stopper member releasably connected to the guide member and the rail, and a handlebar connected to the guide member. The position of the handlebar may be easily adjusted to meet the varying needs of patients in supporting movements onto or about the table. In a preferred embodiment, the handlebar pivots about the guide member to a stowed position below the top surface of the table. Also in a preferred embodiment the stopper member is configured with a handhold for one-handed release and sliding of the guide member relative to the rail. The present invention provides adjustability, simplicity, and the desired sturdy support.

5 Claims, 1 Drawing Sheet

Fig. 1
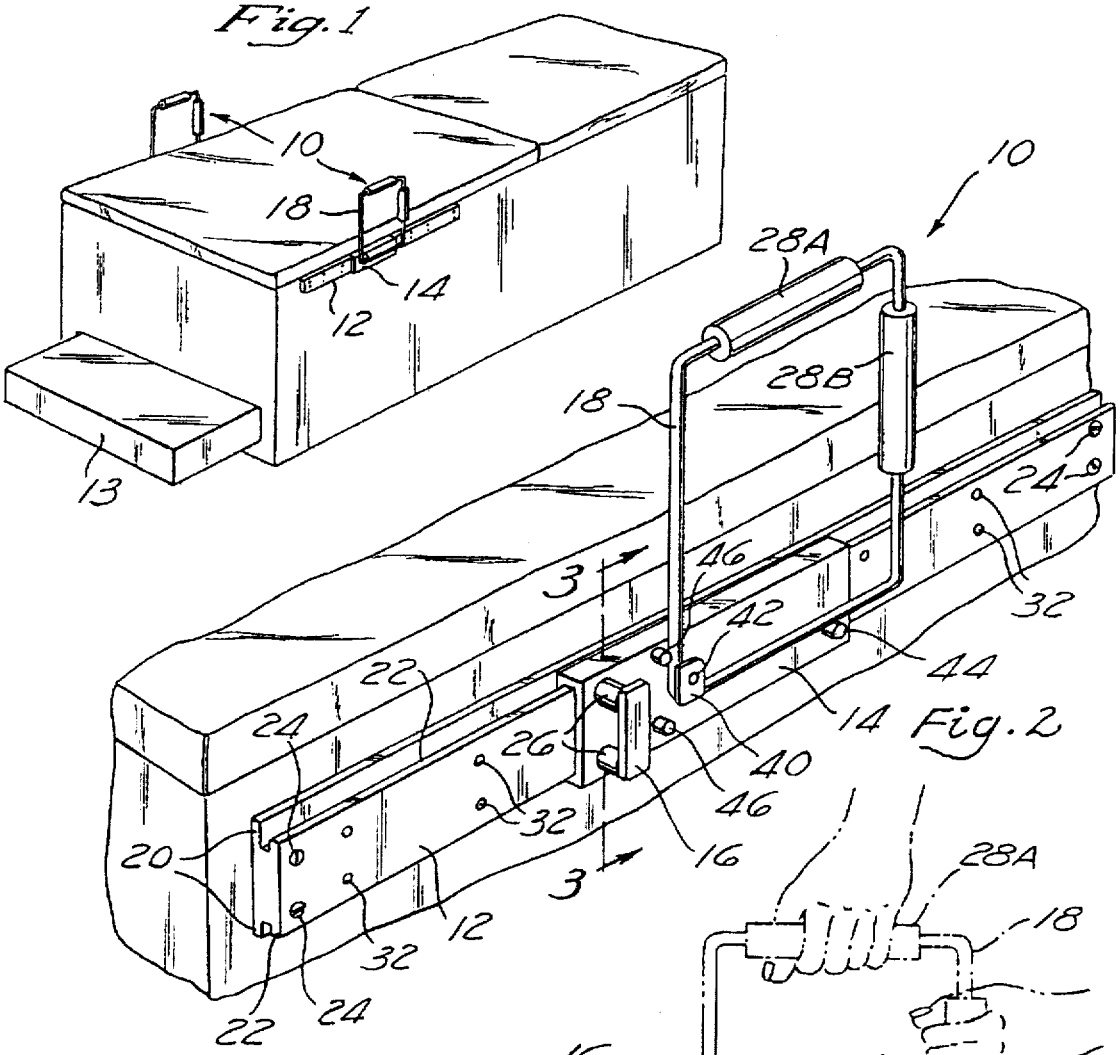
Fig. 2
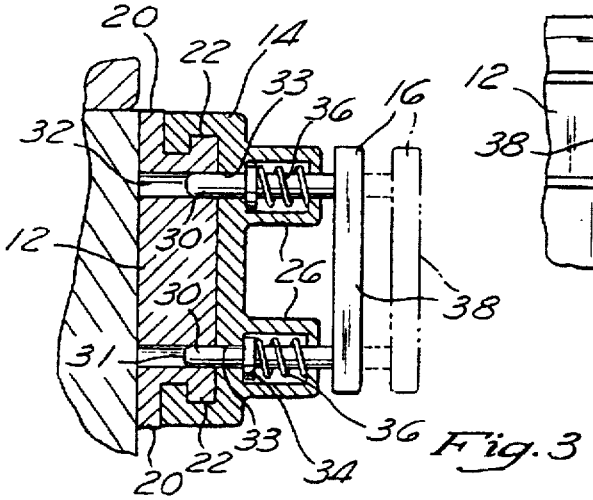
Fig. 3
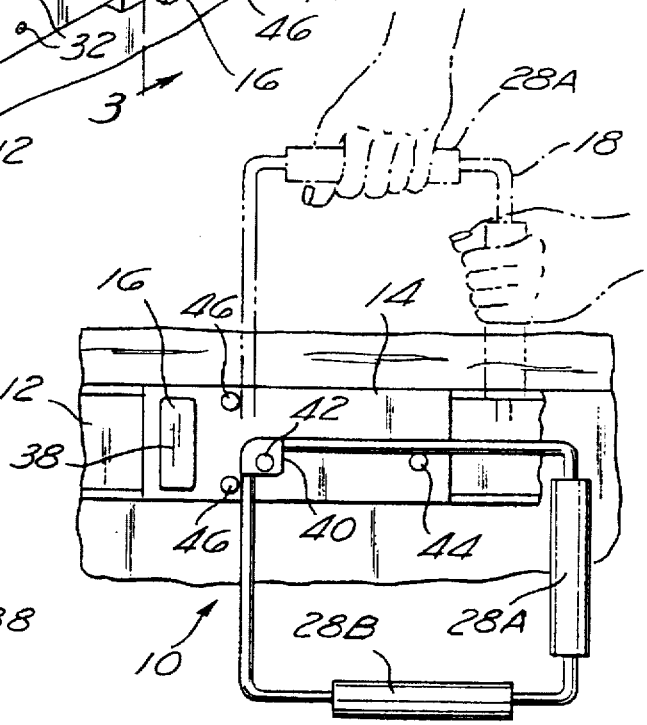
Fig. 4

MEDICAL EXAMINATION TABLE HANDLE SYSTEM

FIELD OF THE INVENTION

The present invention relates generally to a handle system to aid a patient in maneuvering onto and about a medical examination table, and more particularly to a handlebar movably attached to the table enabling the handlebar to be easily adjusted to a plurality of positions.

BACKGROUND OF THE INVENTION

Handles and grab bars to aid elderly or infirm individuals in rising from a reclined position on a medical examination table or hospital bed are well known. Advances in medical technology have led to a longer or life spans and a general aging of the population. Increasing numbers of elderly persons are generally able to fend for themselves but may have difficulty getting in or out of bed or rising up from an exam table when they visit doctors. Persons who are ill or have suffered disabling accidents may be asked to move around on an exam table to enable diagnosis by a doctor or for x-rays to be taken. These individuals may be relatively weak and somewhat incapacitated, but often only need something convenient to grab onto for support rather than relying upon outside assistance.

The prior art has provided a wide variety of devices to enable persons to get out of bed or up from a medical examination table. A removable bedside grab bar is disclosed in U.S. Pat. No. 5,231,721 issued to Fish. The grab bar is of an inverted U-shape and disposed along the length of the bed, but adjusting the position along the length of the bed to accommodate the user requires disassembling screws and C-clamps from the bed frame. A similar device called a security rail attachment is disclosed in U.S. Pat. No. 5,384,927 issued to Mardero et al. Here again, the attachment member is mounted to a clamping bracket for clamped attachment to a side rail of the bed, thus the longitudinal position of the security rail is not easily adjustable. A birth assist handrail is disclosed in U.S. Pat. No. 5,129,117 issued to Celestina et al (1992). The handrail is substantial providing multiple grip positions for the mother, and a complex parallelogram linkage provides for shifting the side guard to an inoperative position tucked below the patient support. A hand grip attachment for a patient's bed is disclosed in U.S. Pat. No. Des. 308,779 issued to Foster. This device is very simple as it is manually positioned anywhere along the bed, but it appears to be lacking the structural ability to provide a strong-enough support for the patient. Other prior art devices include bed gates or side guards which predominantly function to prevent patients from falling out of hospital beds, rather than to aid a patient in maneuvering on or about an exam table.

Although the prior art devices have proven generally suitable for their intended purposes, they possess inherent deficiencies which detract from their overall effectiveness and desirability. The handles or grab bars are not easily adjustable to be positioned along the exam table or bed to accommodate the varying needs of patients. Some of the devices are needlessly complex providing expensive mechanisms or linkages to move the handle to an inoperative position. Those devices which are simple tend not to be sturdy enough to function well in supporting loads induced on them by patients moving about an exam table. The solutions proposed below, to Applicant's knowledge, have heretofore never been addressed.

SUMMARY OF THE INVENTION

The present invention specifically addresses and alleviates the above-mentioned deficiencies associated with the prior art. Generally, the present invention comprises a handle system for attachment to a medical examination table including a handlebar connected to a guide member that slides along a rail mounted to the exam table, for the patient's use in supporting themselves in maneuvering about the exam table. More particularly, the handle system also includes a stopper member releasably attached to the guide member and the rail, so that once the handle is placed in the desired position, it is fixed to act as a sturdy support for the patient.

In a preferred embodiment of the invention, the handlebar is pivotally connected to the guide member, so that it may be pivoted below the horizontal surface of the exam table when not in use. Also in the preferred embodiment, the handlebar is of a rectangular shape and includes at least two grips along two sides of the handlebar. The handlebar bears against a release pin, and upon releasing the pin, the handlebar is able to pivot about the connection to the inoperative position.

The preferred embodiment further provides that the stopper member is movably attached but captive to the guide member, such that release of the stopper member from the rail allows movement of the guide member, and movement of the guide member relative to the rail may be accomplished with one hand in a continuous movement. The stopper member is preferably biased towards being engaged in the rail affixing the position of the guide member and handlebar.

An example of the use of the medical examination table handle system of the present invention is as follows. The handlebars are already in an upright position or are pivoted into an upright position to be above the horizontal surface of the exam table. A patient approaches the exam table and grabs the handlebars to steady themselves while pivoting to take a seated position. The position of the handlebars along the exam table are adjusted to suit the needs of the patient. The patient may grip the handlebars and use them as a support to recline to a laying flat position, with a lessened possibility of back strain or injury to weak stomach muscles. Also, when the patient desires to sit up he or she may again grip the grab bar and use their arms to return to a sitting position.

These, as well as other advantages of the present invention will become more apparent from the following description and drawings. It is understood that changes in the specific structure shown and described may be made within the scope of the claims without departing from the spirit of the invention.

BRIEF DESCRIPTION OF THE DRAWINGS

FIG. 1 is a perspective view of a conventional medical examination table with the handle system of the present invention;

FIG. 2 is a perspective view of the components of the handle system of the present invention;

FIG. 3 is a cross-section view of the stopper member of the present invention; and FIG. 4 is a side view showing the pivoting handlebar of the present invention.

DETAILED DESCRIPTION OF THE PREFERRED EMBODIMENT

The detailed discussion set forth below in connection with the appended drawings is intended as a description of the presently preferred embodiment of the invention, and is not intended to represent the only form in which the present invention may be constructed or utilized. The discussion sets forth the functions and sequences of steps for constructing and operating the invention in connection with the illustrated embodiment. It is to be understood, however, that the same or equivalent functions and sequences may be accomplished by different embodiments that are also intended to be encompassed within the spirit and scope of the invention.

The medical examination table handle system 10 of the present invention is illustrated in FIGS. 1–4 which depict a presently preferred embodiment of the invention. Referring now to FIGS. 1 and 2, the handle system 10 is comprised generally of a rail 12 mounted to the table, preferably along the top side edge of the table at the lower end as shown in FIG. 1. A guide member 14 is slidably connected to the rail 12. A stopper member 16 is releasably connected to the guide member 14 and the rail 12 (see FIG. 3). A handlebar 18 is connected to the guide member 14. A physician, nurse, or patient on the table is able to adjust the position of the handlebar 18 for the patient's use in supporting movements onto or about the table.

Referring now to FIGS. 2 and 3, the components of the handle system 10 of a preferred embodiment of the present invention may be described in more detail. The rail 12 is approximately three feet in length and of an H-shaped cross-section having inboard legs 20, and outboard legs 22 which form a track-like structure. The gap between the inboard and outboard legs 20 and 22 is preferably sufficiently wide to allow easy cleaning of the rail 12. The rail 12 is attached with approximately six counter-sunk flush-head screws 24. The guide member 14 is approximately one foot in length and of a C-shaped cross-section sized to ride along the outboard legs 22 of the rail 12. The guide member 14 also preferably includes a pair of retainer sleeves 26 through which the stopper member 16 is attached to the guide member 14. Also attached to the guide member 14 is a closed rectangular handlebar 18 having a pair of grips 28A and 28B. The top grip 28A and side grip 28B are preferably fabricated of a durable plastic material. The stopper member 16 is preferably configured as having a pair of pins 30 sized to be slidably received within one of several pairs of clearance holes 32 spaced apart along the guide rail 12 as aligned with a pair of clearance holes 33 in the guide member 14. The pins 30 may in addition have a chamfered end 31 for ease of insertion in the clearance holes 32. The pair of pins 30 each have a flange 34 sized to be slidably received inside the sleeve 36 of the guide member 14. Also, inside each of the sleeves 26 is a biasing member, preferably a compression spring 36 disposed around the pin 30. The pair of pins 30 are preferably connected via a handhold 38.

Now also referring to FIG. 4 as well as FIG. 2, the pivoting feature of the handlebar 18 of the handle system 10 of the preferred embodiment of the present invention may be described. The handlebar 18 preferably has a corner piece 40 through which the handlebar 18 is pivotally connected to the guide member 14 by a swing arm bolt 42. The handlebar 18 in an upright position is locked in place by a release pin 44, which is movably connected to the guide member 14. The release pin 44 is a captive spring-loaded pin responsive to thumb pressure, that depresses inside the guide member 14 and allows the handlebar 18 to pivot past the depressed pin. A pair of stabilizing pins 46 are fixed to the guide member 14 such that the handlebar 18 bears against the stabilizing pins 46 in both the upright (FIG. 2) and stowed (FIG. 4) positions. All the major components of the handle system 10, especially those subject to sliding and wear, namely the rail 12, the guide member 14, and the stopper member 16, are preferably fabricated from stainless steel or some other metal capable of withstanding sliding friction forces.

Now the operation, function, and use of the handle system 10 of the preferred embodiment of the present invention may be described. First referring to FIG. 1, the patient steps onto the stool 13 on the lower end of the table and seats himself on the lower end of the top surface of the table. In lowering himself from a standing to seated position, the patient may use one or both of the handlebars 18 at the top grip **28*a* to assist in gradually shifting the weight of his body from his legs in the standing position to his seat in the sitting position. The handlebars 18 would be pivoted about the swing arm bolt 42 from the stowed position (FIG. 4) to the upright position (FIG. 2), and locked in placed by the release pin 44, and further supported by the stabilizing pin 46. The position of the handlebars 18 along the rail 12 along the table may be adjusted by pulling on the handle hold 38 of the stopper member 16, thereby causing the flanges 34 to compress the springs 36 inside the retainer sleeves 26 of the guide member 14, sliding the pins 30 outside the pair of holes 32 in the rail 12 (FIG. 3). Then the handle hold 38 is pushed longitudinally to move the guide member 14 along the rail 12 to the desired position of the set of clearance holes 32 in the rail 12. The guide member 14 and rail 12 are preferably marked with matching arrows (not shown) or configured with notches in the structure (not shown) to facilitate aligning the clearance holes 33 and 32, respectively. If the patient is asked to lie back on the top surface of the table, he may grasp the side grips 28*b* of the handlebars 18 of the handle system 10 to support shifting his weight from his seat to his back as he lays down on the exam table. In making other movements on the exam table, e.g., turning onto one side, the patient may similarly grasp the top grip 28*a* or the side grip 28*b* of the handlebar 18 to turn his body in this manner. In rising from a reclined position to a seated position, and further in rising from a seated position to a standing position, the handlebars 18 of the handle system 10** may be quickly positioned for the needs of the patient, and used to support those movements.

Thus, the reader will see that the handle system 10 of the preferred embodiment of the present invention provides the advantages of adjustable positioning, simplicity for ease of manufacturing and operation, and the desired sturdy support. It is understood, however, that the medical examination table handle system 10 described herein and shown in the drawings represents only a presently preferred embodiment of the invention. Indeed, various modifications and additions may be made to such an embodiment without departing from the spirit and scope of the invention. These and other modifications and additions may be obvious to those skilled in the art and may be implemented to adopt the present invention for use in a variety of applications.

What is claimed is:

1. A handle system including a medical examination table comprising:

a rail mounted to said table;

a guide member slidably connected to said rail;

a stopper member releasably connected to said guide member and rail; and a handlebar pivotally connected to said guide member such that said handlebar may be pivoted between an upright locked position above the horizontal surface of the table and a stowed position below said horizontal surface;

wherein the guide member has a biasing member to which said stopper member movably connects, such that the stopper member is biased towards being connected to the rail, with the position of the handlebar being thereby adjustable to provide support for a patient in maneuvering onto or about the table.

2. The handle system of claim 1 further comprising:

a release pin against which the handlebar bears, such that releasing the release pin allows the handlebar to pivot about the pivotal connection.

3. The handle system of claim 1 further comprising:

a stabilizing pin against which the handlebar bears in the locked upright position.

4. A handle system including a medical examination table comprising:

a rail having an inboard surface attached to the table, having an outboard leg which forms a track, and having, a plurality of first clearance holes spaced apart along the rail;

a guide member sized to slidably ride along the track, and having a second clearance hole capable of being aligned with the first clearing holes in the rail, and having a retainer sleeve approximately aligned with the second clearance hole;

a stopper member having a pin portion sized to be slidably inserted into the first and second clearance holes when aligned, having a flange portion captive within the retainer sleeve of the guide member, and having a handhold portion such that movement of the handhold portion releases the pin portion from the rail and slides the guide member relative to the rail; and a handlebar pivotally connected to the guide member;

whereby the handlebar may be adjustably positioned to provide support for a patient in sitting, reclining, and rising onto or from the table.

5. The handle system of claim 4 having a compression spring disposed inside the retainer sleeve of the guide member and bearing against the flange portion of the stopper member, such that the pin portion of the stopper member is biased towards being inserted into the first clearance holes in the rail.

* * * * *